US006213437B1

(12) United States Patent
Robbins

(10) Patent No.: US 6,213,437 B1
(45) Date of Patent: Apr. 10, 2001

(54) INDUSTRIAL CURTAIN BRACKETS

(75) Inventor: George Robbins, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 0 days.

(21) Appl. No.: 09/408,505

(22) Filed: Sep. 30, 1999

(51) Int. Cl.[7] ..... A47H 1/142

(52) U.S. Cl. ..... 248/261; 248/251; 211/105.1; 211/123; 160/330

(58) Field of Search ..... 248/251, 261, 248/262, 215, 252, 316.1, 318; 211/105.1, 123; 160/330, DIG. 6; 4/608, 558

(56) References Cited

U.S. PATENT DOCUMENTS

| | | | | |
|---|---|---|---|---|
| D. 269,576 | | 7/1983 | Robbins, Jr. | D6/208.1 |
| 614,742 | * | 11/1898 | McFaddin et al. | 248/252 |
| 1,003,966 | * | 9/1911 | Lathrop | 248/262 |
| 1,057,043 | * | 3/1913 | Dohm | 248/262 |
| 1,073,231 | * | 9/1913 | Harrison | 248/251 |
| 1,752,683 | * | 4/1930 | Meagher | 248/251 |
| 2,065,226 | * | 12/1936 | Kennedy | 4/558 |
| 2,528,358 | * | 10/1950 | Grass | 248/251 |
| 2,606,667 | * | 8/1952 | Hornick | 248/251 |
| 2,778,030 | * | 1/1957 | Goche | 160/330 |
| 4,643,318 | * | 2/1987 | Kopp | 248/251 |
| 5,651,407 | * | 7/1997 | Perez | 160/330 |
| 5,960,850 | * | 10/1999 | Colson et al. | 160/236 |
| 6,041,454 | * | 3/2000 | Summerford | 4/608 |

FOREIGN PATENT DOCUMENTS

| | | | | |
|---|---|---|---|---|
| 15139 | * | 12/1900 | (GB) | 211/105.1 |

* cited by examiner

*Primary Examiner*—Ramon O. Ramirez
*Assistant Examiner*—Jon Szumny
(74) *Attorney, Agent, or Firm*—Nixon & Vanderhye P.C.

(57) ABSTRACT

A bracket assembly for supporting one or more curtain strips includes an elongated rod; a first bracket having a slot therein for supporting one end of the rod; a second bracket having means therein for supporting an opposite end of the rod. The first bracket has at least two fastener holes therein, and the rod has a through hole at one end thereof perpendicular to an axis of the rod. The through hole is alignable with one of the fastener holes so that a fastener may extend through the through hole and one of the fastener holes to thereby lock the rod to the one bracket.

12 Claims, 4 Drawing Sheets

INDUSTRIAL CURTAIN BRACKETS

TECHNICAL FIELD

This invention relates to industrial curtains and, particularly, to a bracket and rod assembly for supporting an industrial curtain.

BACKGROUND

Industrial curtains are conventionally employed to provide closures between, for example, separate manufacturing areas within large buildings, warehouses and the like. On a smaller scale, they are used to cover smaller doorways to temperature controlled rooms or the like. The general idea is to provide a closure which nevertheless allows foot or vehicular traffic to pass through. These curtains are generally made up of side-by-side elongated plastic strips which hang from a bracket assembly mounted on a wall and extending across the top of the opening. More often than not, the strips are translucent or at least semi-transparent so that persons or vehicles approaching the curtain can see if the way is clear on the other side of the curtain.

It is often necessary to replace one or more of the elongated strips and to date, this has proven to be a time consuming effort if it is necessary to remove one or both of the wall mounted brackets.

SUMMARY OF THE INVENTION

This invention relates to a new and improved bracket assembly design which allows quick and easy installation and replacement of industrial curtain strips on a supporting rod. This is done by providing a unique bracket and rod structure which allows curtain strips to be loaded onto the supporting rod without having to remove either of the two wall mounted brackets.

In an exemplary embodiment of the invention, one wall mounted bracket is provided with a rod supporting hole while the opposite wall mounted bracket is provided with a rod supporting an open-ended slot or groove. The hole in the one supporting bracket is large enough to permit the rod to be raised out of the open-ended slot in the opposite bracket while nevertheless providing support for the rod, thus taking up the weight of not only the rod itself but also of the curtain strips loaded onto the rod.

It is another feature of the invention that one of the mounting screws for the bracket containing the open-ended slot is alignable with a through hole in the rod itself so that when the mounting screw is installed, it also passes through the curtain supporting rod, thereby locking the rod in place.

Accordingly, in its broader aspects, the present invention relates to a bracket assembly for supporting one or more curtain strips, the assembly comprising an elongated rod; a first wall mount bracket adapted to support one end of the rod; a second wall mount bracket adapted to support an opposite end of the rod; and means for permitting one or more elongated curtain strips to be loaded onto the rod when the first and second brackets are secured to a wall, without having to remove either of the first and second brackets from the wall.

In another aspect, the invention relates to a bracket assembly for supporting one or more curtain strips, the assembly comprising an elongated rod; a first bracket having a slot therein for supporting one end of the rod; a second bracket having a hole therein for supporting an opposite end of the rod; the first bracket having at least two fastener holes therein and the rod having a through hole at one end thereof perpendicular to an axis of the rod, the through hole alignable with one of at least two fastener holes so that a fastener may extend through the through hole and said one of at least two fastener holes to thereby lock the rod to the one bracket.

In still another aspect, the invention relates to an industrial curtain assembly comprising an elongated rod supporting a plurality of elongated curtain strips; a first bracket adapted for mounting on a wall surface and having a slot therein for supporting one end of the rod; a second bracket adapted for mounting on the wall surface and having a hole therein for supporting an opposite end of the rod; the first bracket having at least two fastener holes therein and the elongated rod having a through hole at one end thereof perpendicular to an axis of the elongated rod, the through hole alignable with one of at least two fastener holes so that a fastener may extend through the through hole and one of at least two fastener holes to thereby lock the elongated rod to the one bracket.

Additional objects and advantages of the subject invention will become apparent from the detailed description which follows.

BEST MODE FOR CARRYING OUT THE INVENTION

Figures 1, 2:
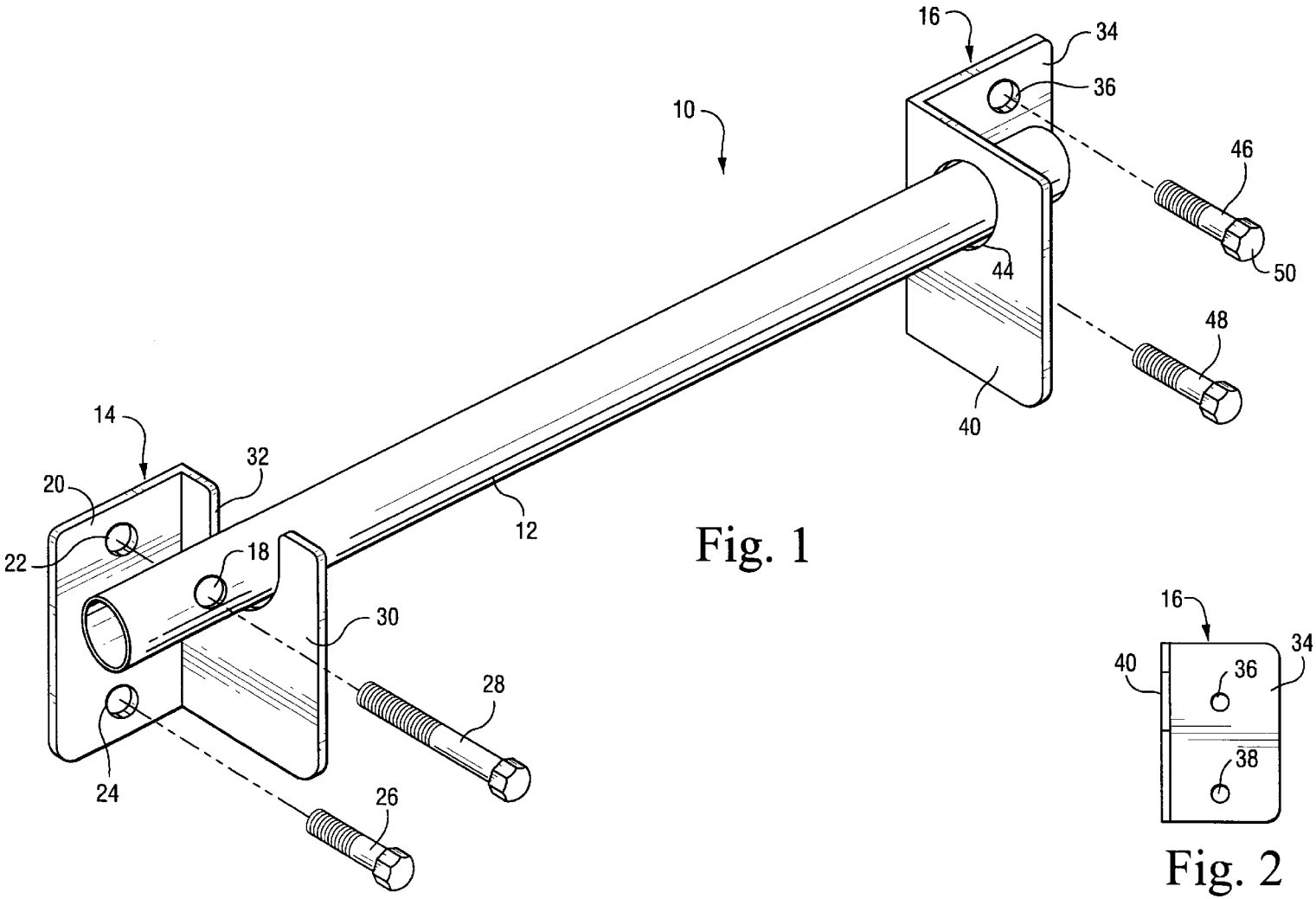
FIG. 1 is a perspective view of a bracket assembly for use with traffic curtains in accordance with the invention.
FIG. 2 is a side elevation of one of the brackets illustrated in FIG. 1.

With reference to FIGS. 1 and 2, the bracket assembly 10 in accordance with the invention includes a first bracket 14 and a second bracket 16, both designed to be mounted on a wall or other vertical surface for supporting the rod 12. The rod 12 comprises a hollow tube provided with a through hole 18 perpendicular to the longitudinal axis of the tube, at the far left of the tube as viewed in FIG. 1.

Bracket 14 includes a first planar portion 20 with mounting holes 22 and 24 adapted to receive bolts or screws 26 and 28 (or other suitable fasteners), by which the bracket 14 can be secured to a vertical wall surface. A second planar portion 30 extends generally perpendicular to the first planar portion 20 and is provided with a generally U-shaped slot 32, opening at the top of the bracket portion 30, and adapted to support one end of the rod or tube 12.

The bracket 16 is generally similar to the bracket 14 with one significant difference noted below. The bracket includes a first planar portion 34 provided with a pair of holes 36, 38 by which the bracket 16 is secured to a vertical wall surface by means of bolts or screws 46, 48. A second planar portion 40 of the bracket extends generally perpendicularly to the first planar portion 34 but, unlike corresponding portion 30, is provided with a hole 44 for supporting the opposite end of the rod 12.

The supporting rod or tube 12 is fixed in place by having the bolt or screw 28 extend through the hole 18 in the tube 12 and then through the mounting hole 22 of the bracket 14.

At the same time, it can be appreciated especially from FIG. 2 that the bolt head 50 of the mounting bolt or screw 46 is located relative to the hole 44 in the second planar portion 40 of the bracket 16 such that when the tube 12 is in place, the peripheral surface of the tube will bear against the head 50 of the bolt with sufficient friction to prevent the tube 12 from sliding out of the bracket, especially when the bolt 28 at the opposite end of the tube is not yet in place.

Figure 3:
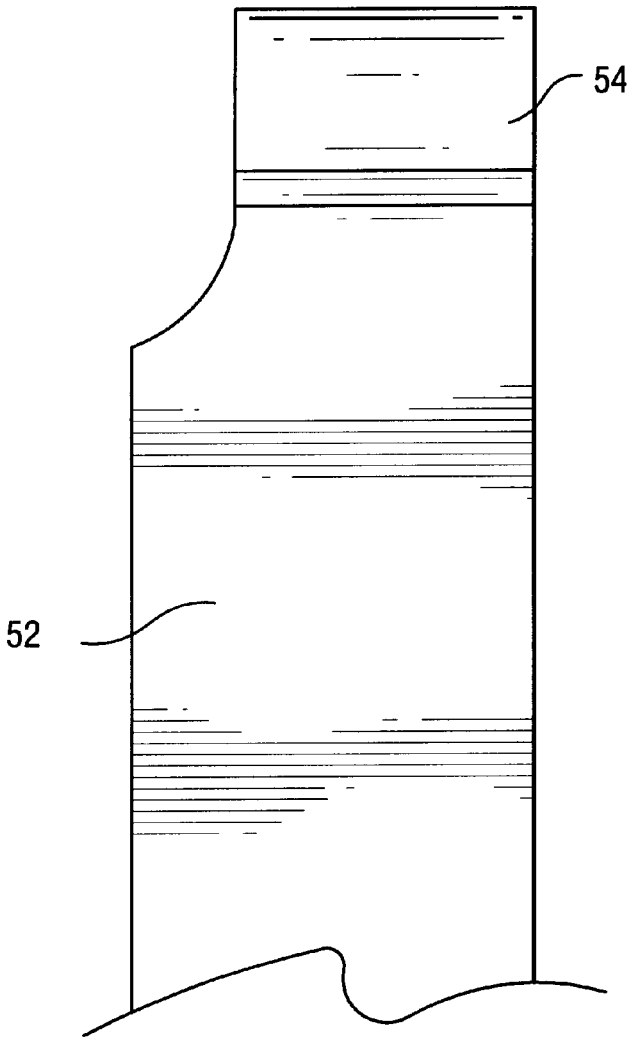
FIG. 3 is a partial front elevation of a single curtain strip.
Figure 4:
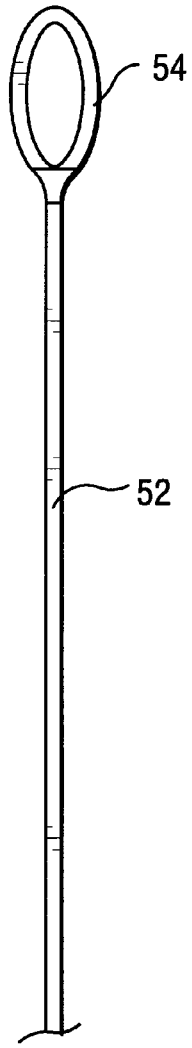
FIG. 4 is a side elevation of FIG. 3.
Figure 5:
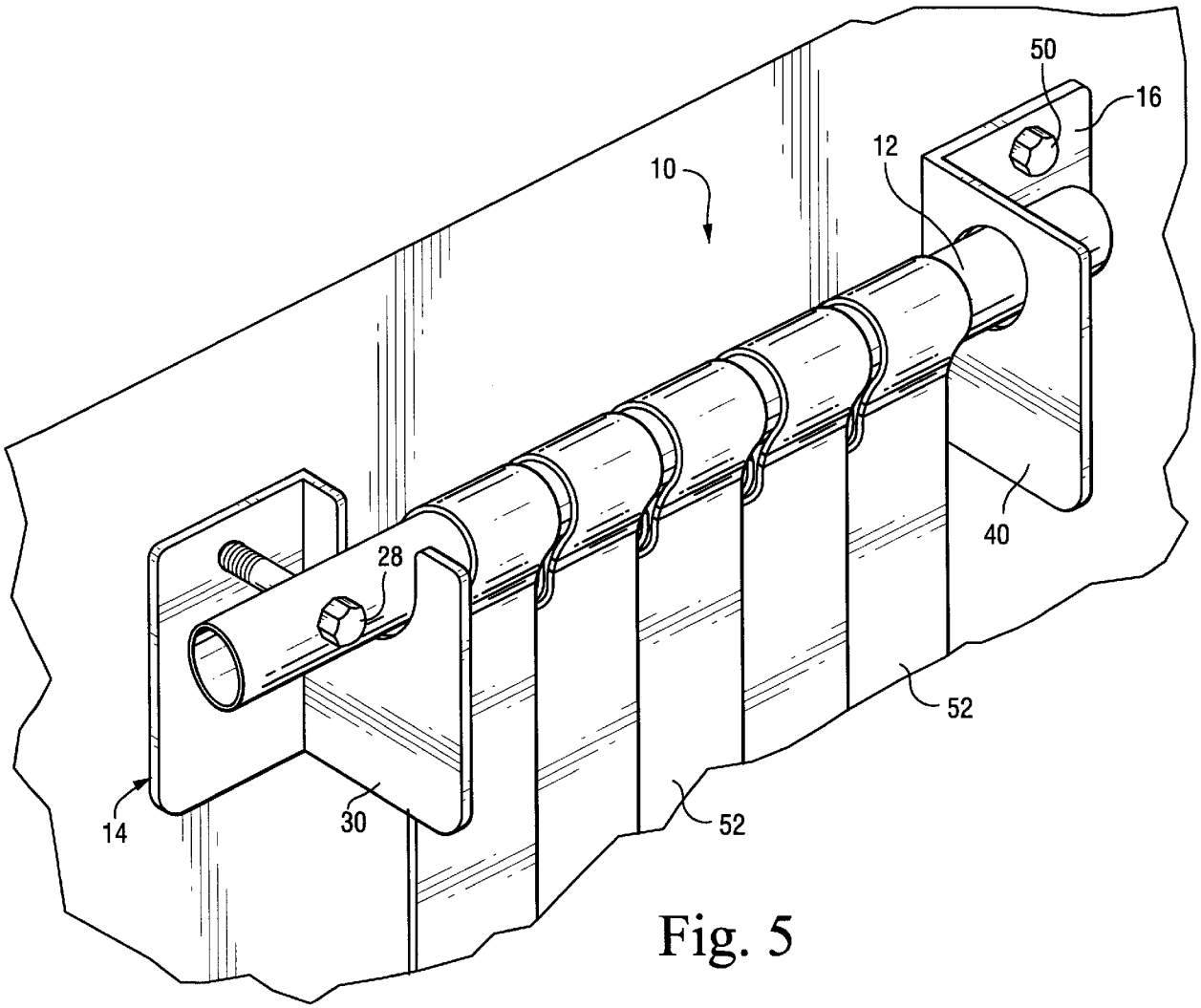
FIG. 5 is a perspective view similar to FIG. 1 but shown installed with industrial curtain strips loaded onto the bracket assembly.

With reference to FIGS. 3 and 4, the curtain strips are typically constructed of relatively heavy weight, translucent or semi-transparent plastic strips 52. One end may be doubled back on itself and welded to form a closed loop 54 used to mount the strip on the supporting rod. The strips 52 are loaded onto the supporting rod so as to be in close side-by-side relationship as best seen in FIG. 5.

In use, and with reference again to FIG. 5, the brackets 14 and 16 are first secured to the vertical wall surface, but bracket 14 is secured initially only by bolt or screw 26 passing through hole 24. The industrial curtain strips 52 are then loaded onto the supporting tube or rod 12 in either of two ways. In a first technique, the rod or tube 12 is separated from the brackets 14, 16 while the curtain strips 52 are loaded onto the rod, via loops 54. One end of the loaded rod 12 is then inserted into the hole 44, and the other end then dropped into the U-shaped slot 32. The mounting bolt 28 is then inserted through the hole 18 in the tube, and through the hole 22 in the bracket 14 and into the vertical wall surface to lock the supporting rod 12 in place.

In an alternative technique, the right end of the rod 12 (as viewed in FIG. 1) remains in the hole 44 and the other end of the rod is lifted out of the slot 32 so that the curtain strips 52 can be loaded onto the rod 12. It can be appreciated that in this manner, the majority of the weight of the rod and the curtain strips is taken up by the bracket 16 (and hence the wall to which it is secured). Once the curtain strips are loaded onto the supporting rod 12, the rod end can be dropped into the slot 32 and again secured by the bolt 28 as described above. In this regard, it should be noted that the diameter of the hole 44 is sufficiently large that it allows the rod 12 to be pivoted upwardly out of the slot 32 to facilitate the curtain strip loading operation.

Figure 6:
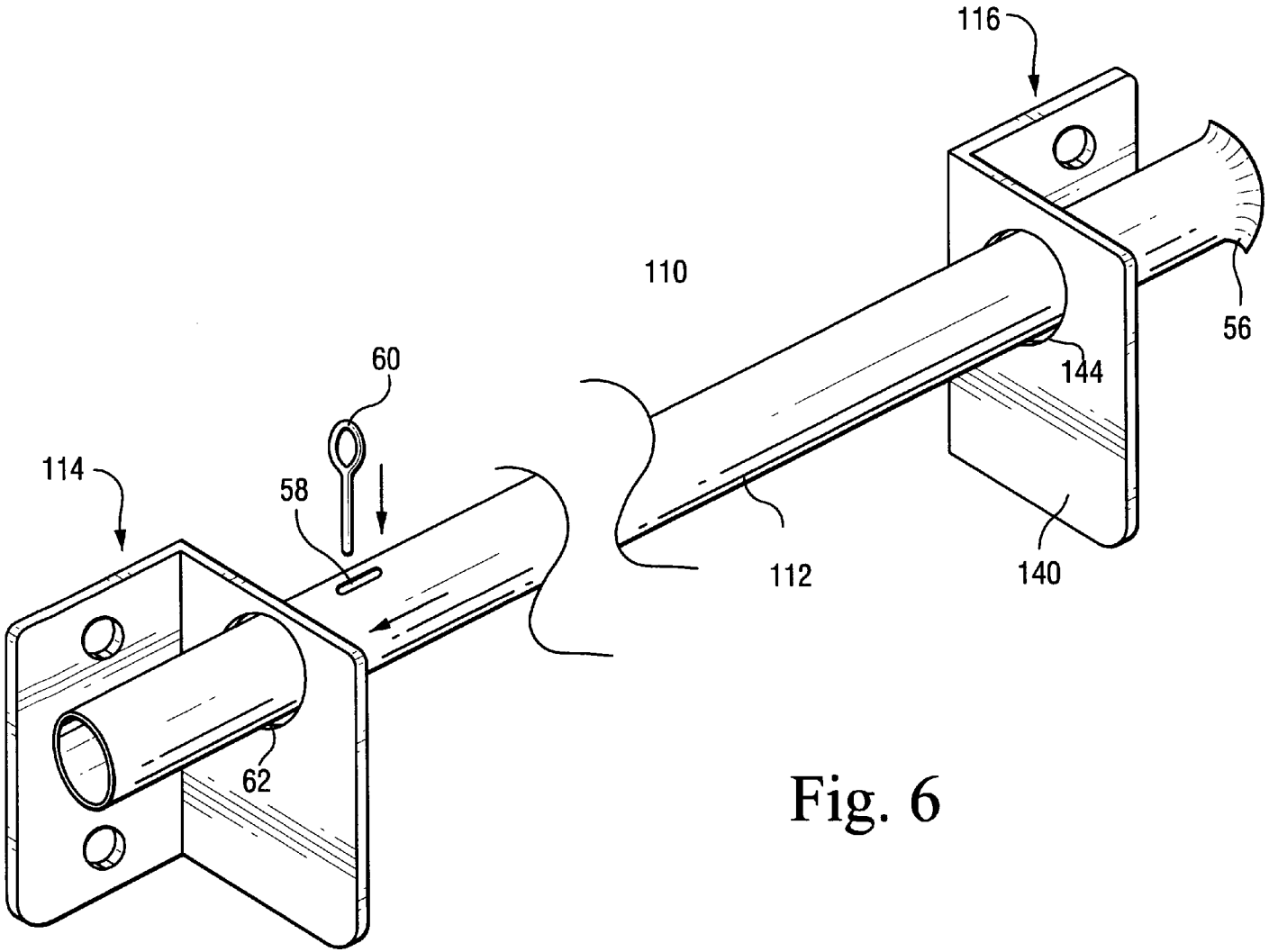
FIG. 6 is a perspective view of a bracket assembly in accordance with another embodiment of the invention.

Other bracket and rod constructions can be utilized to achieve the same objectives. For example, and with reference to FIG. 6, brackets 114 and 116 are similar to brackets 14 and 16, but bracket 114 has a hole 62 rather than an open slot 32. The tube 112 is formed with a swaged end 56 which prevents the rod from passing in a right-to-left direction (as viewed in FIG. 6) through the hole 144. A hole 58 is formed near the other end of the tube, enabling a cotter key 60 to be inserted through the tube.

With the above described construction, the tube 112 may be moved to the left, out of the bracket 114 so that one or more curtain strips (original or replacement) can be loaded onto the tube. Subsequently, the tube 112 is moved to the left until the swaged end 56 abuts the planar portion 140 of the bracket 116, with the opposite end of the tube extending through the hole 62 in bracket 114. In this position, hole 58 lies to the outside of bracket 114 and cotter key 60 will prevent the tube from moving back out of the hole 62.

Other combinations of keys, stops and the like may be employed to lock the tube in place after original or replacement strips have been installed or the like. For example, the head on bolt 28 (FIG. 1) may be employed as a stop to prevent movement of the tube 112 to the left as viewed in FIG. 6, with a cotter key located adjacent but inside the bracket 116 to prevent movement to the right. In all cases, replacement or original curtain strips can be loaded onto the tube without removing either of the wall mounted brackets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bracket assembly for supporting one or more curtain strips adapted to be secured to a vertical surface, the assembly comprising:

an elongated rod;

a first bracket having a slot therein for supporting one end of said rod;

a second bracket having a rod-supporting hole therein for supporting an opposite end of said rod;

said first bracket having at least two fastener holes therein and said rod having a through hole at one end thereof perpendicular to an axis of said rod, said through hole alignable with one of said at least two fastener holes so that a fastener is adapted to extend through said through hole into said one of said at least two fastener holes and into said vertical surface to thereby lock said rod to said first bracket.

2. The bracket assembly of claim 1 wherein each of said first and second brackets have a first planar portion for engagement with a wall surface and a second planar portion extending substantially perpendicularly from said first planar surface.

3. The bracket assembly of claim 2 wherein said slot in said first bracket and said rod supporting hole in said second bracket are located in respective ones of said second planar portions.

4. The bracket assembly of claim 2 wherein said at least two fastener holes in said first bracket are located in said first planar portion thereof, and wherein said second bracket has a pair of fastener holes in said first planar portion thereof.

5. The bracket assembly of claim 1 wherein said rod has a diameter smaller than said rod supporting hole in said second bracket such that said rod fits loosely into said rod supporting hole, allowing said one end of said rod to move out of said slot.

6. A bracket assembly for supporting one or more curtain strips, the assembly comprising:

an elongated rod;

a first bracket having a slot therein for supporting one end of said rod;

a second bracket having a rod-supporting hole therein for supporting an opposite end of said rod;

said first bracket having at least two fastener holes therein and said rod having a through hole at one end thereof perpendicular to an axis of said rod, said through hole alignable with one of said at least two fastener holes so that a fastener may extend through said through hole and said one of said at least two fastener holes to thereby lock said rod to said first bracket; wherein each of said first and second brackets have a first planar portion for engagement with a wall surface and a second planar portion extending substantially perpendicularly from said first planar surface; wherein said at least two fastener holes in said first bracket are located in said first planar portion thereof, and wherein said second bracket has a pair of fastener holes in said first planar portion thereof; and wherein one of said pair of fastener holes in said second bracket lies adjacent said rod supporting hole such that said opposite end of the rod engages a head of a fastener inserted in said one fastener hole.

7. An industrial curtain assembly comprising:

an elongated rod supporting a plurality of elongated curtain strips;

a first bracket adapted for mounting on a wall surface and having a slot therein for supporting one end of said rod;

a second bracket adapted for mounting on the wall surface and having a rod-supporting hole therein for supporting an opposite end of said rod;

said first bracket having at least two fastener holes therein and said elongated rod having a through hole at one end thereof perpendicular to an axis of said elongated rod, said through hole alignable with one of said at least two fastener holes so that a fastener is adapted to extend through said through hole into said one of said at least two fastener holes and into said will surface to thereby lock said elongated rod to said one bracket.

8. The industrial curtain assembly of claim 7 wherein said rod has a diameter smaller than said rod-supporting hole in said second bracket such that said rod fits loosely into said rod-supporting hole, allowing said one end of said rod to move out of said slot.

9. The industrial curtain assembly of claim 7 wherein each of said elongated curtain strips has a closed loop by which said curtain strips are supported on said rod.

10. The industrial curtain assembly of claim 7 wherein each of said first and second brackets have a first planar portion for engagement with the wall surface and a second planar portion extending substantially perpendicularly from said first planar surface.

11. An industrial curtain assembly comprising:

a first bracket adapted for mounting on a wall surface and having a slot therein for supporting one end of said rod;

a second bracket adapted for mounting on the wall surface and having a rod-supporting hole therein for supporting an opposite end of said rod;

said first bracket having at least two fastener holes therein and said elongated rod having a through hole at one end thereof perpendicular to an axis of said elongated rod, said through hole alignable with one of said at least two fastener holes so that a fastener may extend through said through hole and said one of said at least two fastener holes to thereby lock said elongated rod to said one bracket; wherein said slot in said first bracket and said rod-supporting hole in said second bracket are located in respective ones of said second planar portions.

12. An industrial curtain assembly comprising:

a first bracket adapted for mounting on a wall surface and having a slot therein for supporting one end of said rod;

a second bracket adapted for mounting on the wall surface and having a rod-supporting hole therein for supporting an opposite end of said rod;

said first bracket having at least two fastener holes therein and said elongated rod having a through hole at one end thereof perpendicular to an axis of said elongated rod, said through hole alignable with one of said at least two fastener holes so that a fastener may extend through said through hole and said one of said at least two fastener holes to thereby lock said elongated rod to said one bracket; wherein each of said first and second brackets have a first planar portion for engagement with the wall surface and a second planar portion extending substantially perpendicularly from said first planar surface; and wherein said second bracket has two fastener holes in said first planar portion, one of said two fastener holes lying adjacent said rod supporting hole such that said opposite end of the rod engages a head of a fastener inserted in said one of said two fastener holes.

* * * * *